US008197229B2

(12) United States Patent
Mitsui et al.

(10) Patent No.: US 8,197,229 B2
(45) Date of Patent: Jun. 12, 2012

(54) DOUBLE-HEADED PISTON TYPE COMPRESSOR

(75) Inventors: Tsubasa Mitsui, Kariya (JP); Shinichi Sato, Kariya (JP); Manabu Sugiura, Kariya (JP); Keishi Nakagaki, Kariya (JP); Akio Saiki, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 417 days.

(21) Appl. No.: 12/473,024

(22) Filed: May 27, 2009

(65) Prior Publication Data

US 2009/0297369 A1 Dec. 3, 2009

(30) Foreign Application Priority Data

May 29, 2008 (JP) ..... 2008-141072

(51) Int. Cl.
*F04B 1/26* (2006.01)

(52) U.S. Cl. ..... 417/270; 92/71; 91/499

(58) Field of Classification Search ..... 417/218, 417/269, 270, 222.1, 222.2; 92/12.2, 71; 91/499

See application file for complete search history.

(56) References Cited

U.S. PATENT DOCUMENTS

| | | | | |
|---|---|---|---|---|
| 4,730,987 | A * | 3/1988 | Kawai et al. | 417/270 |
| 5,267,839 | A * | 12/1993 | Kimura et al. | 417/269 |
| 5,429,482 | A * | 7/1995 | Takenaka et al. | 417/269 |
| 5,765,996 | A * | 6/1998 | Fujii et al. | 417/269 |
| 5,820,355 | A * | 10/1998 | Ikeda et al. | 417/269 |
| 7,811,066 | B2 | 10/2010 | Ishikawa et al. | |
| 2003/0095873 | A1 * | 5/2003 | Tarutani et al. | 417/222.1 |
| 2003/0108436 | A1 * | 6/2003 | Shintoku et al. | 417/269 |
| 2003/0146053 | A1 * | 8/2003 | Shintoku et al. | 184/6.16 |
| 2004/0216602 | A1 * | 11/2004 | Matsumoto et al. | 91/499 |
| 2004/0228740 | A1 * | 11/2004 | Matsumoto et al. | 417/269 |
| 2005/0053480 | A1 * | 3/2005 | Murakami et al. | 417/313 |
| 2005/0186086 | A1 * | 8/2005 | Ota et al. | 417/269 |
| 2006/0228229 | A1 * | 10/2006 | Inoue | 417/269 |
| 2008/0286125 | A1 * | 11/2008 | Sugiura et al. | 417/269 |
| 2008/0317584 | A1 * | 12/2008 | Murase et al. | 415/112 |
| 2009/0129948 | A1 * | 5/2009 | Hoshino et al. | 417/269 |

FOREIGN PATENT DOCUMENTS

| | | | |
|---|---|---|---|
| EP | 1939448 | A1 | 7/2008 |
| JP | 2007-138925 | A | 6/2007 |
| KR | 2007-14001 | A | 1/2007 |

OTHER PUBLICATIONS

Office Action regarding corresponding Korean Patent Application, dated Feb. 21, 2011.

* cited by examiner

*Primary Examiner* — Joseph L Williams
*Assistant Examiner* — Fatima Farokhrooz
(74) *Attorney, Agent, or Firm* — Locke Lord LLP

(57) ABSTRACT

A double-headed piston type compressor includes front and rear housings, a cylinder block defining therein a crank chamber and a plurality of cylinder bores and having a shaft hole therethrough, a double-headed piston accommodated in the cylinder bores for reciprocating therein, a rotary shaft rotatably supported by the shaft hole, compression chambers defined by the cylinder bores, a suction chamber defined by the front housing and an introduction passage having a rotary valve for introducing refrigerant from the suction chamber into the compression chambers. The introduction passage includes a communication passage formed in the cylinder block for connecting the suction chamber to the shaft hole, suction passages connecting the shaft hole and the compression chambers and a recessed passage formed in the outer circumferential surface of the rotary shaft for connecting intermittently between the communication passage and the respective suction passages in accordance with the rotation of the rotary shaft.

9 Claims, 8 Drawing Sheets

DOUBLE-HEADED PISTON TYPE COMPRESSOR

BACKGROUND OF THE INVENTION

The present invention relates to a double-headed piston type compressor for use in a vehicle air conditioning system.

A compressor disclosed in Japanese Patent Application Publication No. 2007-138925 discloses a suction mechanism including a rotary valve for introducing refrigerant into front compression chambers of the compressor and another suction mechanism including suction valves for introducing refrigerant into rear compression chambers of the compressor. A lip seal-type shaft seal is interposed between a front housing and a rotary shaft of the compressor. The shaft seal is accommodated in a shaft seal chamber formed in the front housing. A recessed passage is formed in the outer circumferential surface of the rotary shaft to serve as a part of the rotary valve. One end of the recessed passage is open to the shaft seal chamber having therein the shaft seal. The other end of the recessed passage is open to the suction passages which are formed in a front cylinder block of the compressor in communication with compression chambers. As the rotary shaft rotates, each suction passage intermittently communicates with the recessed passage, so that refrigerant in the shaft seal chamber is introduced into the compression chambers through the recessed passage and the suction passages.

Since the recessed passage is formed by machining a groove in the outer circumferential surface of the rotary shaft, the manufacturing cost of the rotary shaft is reduced as compared to forming a passage by boring the end of the rotary shaft. Further, the refrigerant flowing through the shaft seal chamber cools the shaft seal, which extends the life of the shaft seal.

However, the recessed passage of the rotary valve disclosed in the above reference No. 2007-138925 extends so as to connect the shaft seal chamber in the front of a valve port plate and the suction passages at rearward of the valve port plate. Thus, the outer circumferential surface of the rotary shaft needs to be grooved for a long distance in the axial direction of the rotary shaft to form the recessed passage. As the length of the recessed passage in the axial direction is increased, the strength of the rotary shaft is reduced. Further, there is another problem in that the shaft seal needs to be located further forward by a distance for which the recessed passage extends forward of the valve port plate. This causes the compressor to become large in size.

The present invention, which has been made in view of the above problems, is directed to providing a double-headed piston type compressor that prevents decreasing the strength of the rotary shaft while minimizing the size of the compressor.

SUMMARY OF THE INVENTION

In accordance with an aspect of the present invention, a double-headed piston type compressor includes a housing assembly including a front housing, a rear housing and a cylinder block defining therein a crank chamber and a plurality of cylinder bores and having a shaft hole therethrough, a double-headed piston accommodated in the cylinder bores for reciprocating therein, a rotary shaft rotatably supported by the shaft hole of the cylinder block, a swash plate accommodated in the crank chamber for rotation with the rotary shaft, a shaft seal arranged between the front housing and the rotary shaft, compression chambers defined by the cylinder bores in the cylinder block, a suction chamber defined by the front housing and an introduction passage having a rotary valve for introducing refrigerant from the suction chamber into the compression chambers. The introduction passage includes a communication passage formed in the cylinder block for connecting the suction chamber to the shaft hole, suction passages connecting the shaft hole and the compression chambers and a recessed passage formed in the outer circumferential surface of the rotary shaft for connecting intermittently between the communication passage and the respective suction passages in accordance with the rotation of the rotary shaft.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
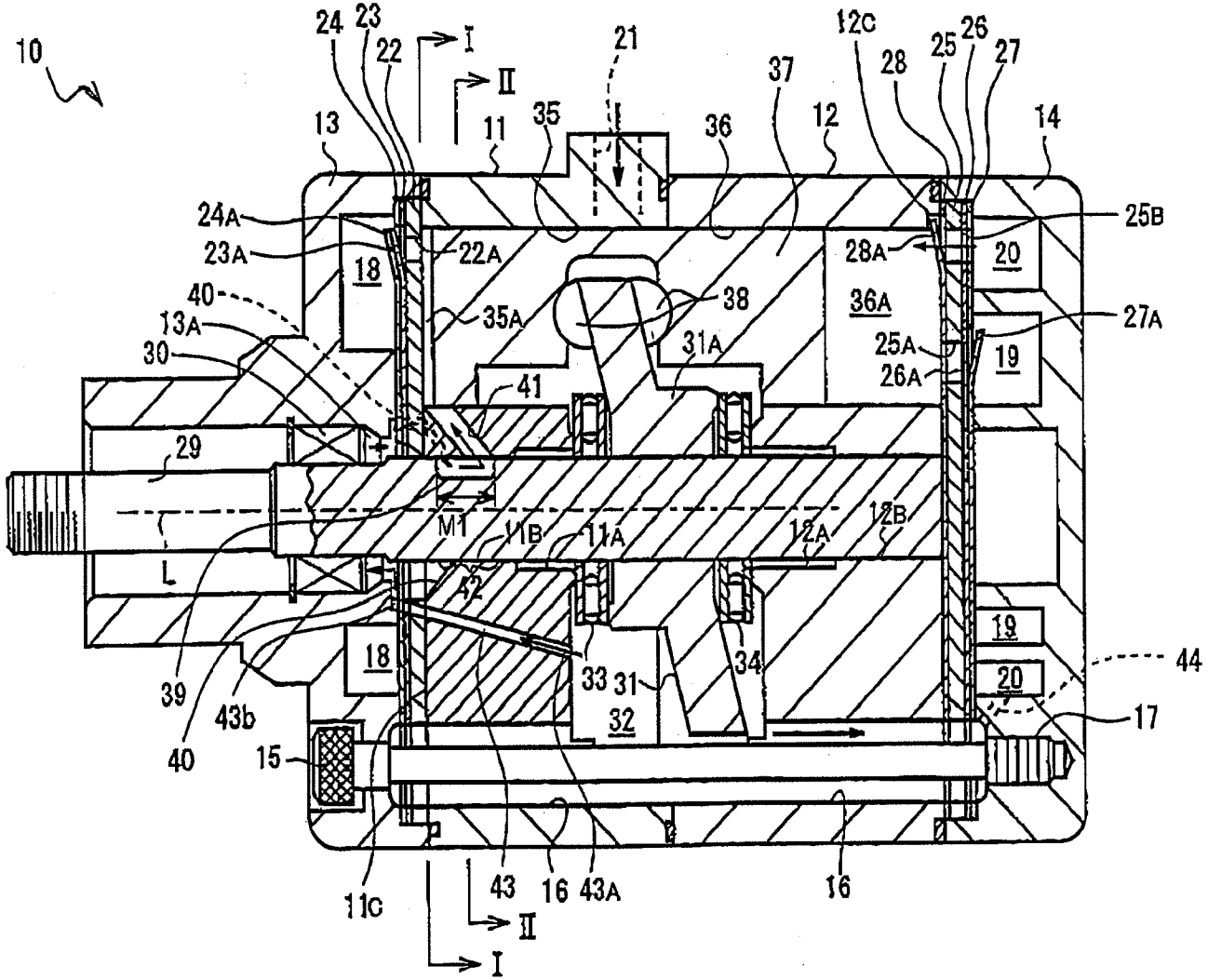
FIG. 1 is a longitudinal cross-sectional view of a double-headed piston type compressor according to a first preferred embodiment of the present invention.

The following will describe the double-headed piston type compressor according to the first preferred embodiment of the present invention while having reference to FIGS. 1 through 5. The double-headed piston type compressor (hereinafter referred to as "compressor") is used in a refrigerant circuit of a vehicle air conditioning system. As shown in FIG. 1 the compressor 10 has a housing assembly which includes a pair of front and rear cylinder blocks 11, 12 connected to each other, a front housing 13 connected to the front end of the front cylinder block 11 and a rear housing 14 connected to the rear end of the rear cylinder block 12. In FIG. 1, the left side corresponds to the front side of the compressor 10 and the right side to the rear side of the compressor 10. The cylinder blocks 11, 12, the front housing 13 and the rear housing 14 are fastened together by a plurality of bolts 15. Each bolt 15 is inserted in a plurality of bolt insertion holes 16 extending through the cylinder blocks 11, 12, the front housing 13 and the rear housing 14 respectively and screwed at the threaded portion 17 formed at the distal end thereof into a threaded hole in the rear housing 14. The bolt insertion hole 16 has a diameter larger than that of the shank of the bolt 15 so that a clearance is defined in the bolt insertion hole 16 when the bolt 15 is inserted in its corresponding bolt insertion hole 16.

A discharge chamber 18 is formed in the front housing 13. A discharge chamber 19 and a suction chamber 20 are formed in the rear housing 14. A suction hole 21 is formed through the shell of the front cylinder block 11 and connected to the external refrigerant circuit (not shown). The inner end of the suction hole 21 is open to a crank chamber 32 defined between the cylinder blocks 11, 12. A valve port plate 22, a discharge valve plate 23 and a retainer plate 24 are interposed between the front housing 13 and the front cylinder block 11. The valve port plate 22 has therethrough a discharge port 22A at a position corresponding to the discharge chamber 18. The discharge valve plate 23 has a discharge valve 23A at a position corresponding to each discharge port 22A. The retainer plate 24 has a retainer 24A for regulating the opening of the discharge valve 23A.

On the other hand, a valve port plate 25, a discharge valve plate 26, a retainer plate 27 and a suction valve plate 28 are interposed between the rear housing 14 and the rear cylinder block 12. The valve port plate 25 has therethrough a discharge port 25A at a position corresponding to the discharge chamber 19 and a suction port 25B at a position corresponding to the suction chamber 20. The discharge valve plate 26 has a discharge valve 26A at a position corresponding to the discharge port 25A. The retainer plate 27 has a retainer 27A for regulating the opening of the discharge valve 26A. The suction valve plate 28 has a suction valve 28A at a position corresponding to each suction port 25B. The inner wall of the rear cylinder block 12 is formed at a position corresponding to the suction valve 28A with a recess 12C serving as a retainer for regulating the opening of the suction valve 28A.

The cylinder blocks 11, 12 rotatably support a rotary shaft 29 which is inserted through shaft holes 11A, 12A formed through the cylinder blocks 11, 12. A lip seal-type shaft seal 30 is arranged between the front housing 13 and the rotary shaft 29. The shaft seal 30 is accommodated in a shaft seal chamber 13A defined in the front housing 13. The shaft seal chamber 13A serves as a front suction chamber of the compressor 10 provided in the front housing 13.

A swash plate 31 is secured to the rotary shaft 29 for rotating integrally. The swash plate 31 is accommodated in the crank chamber 32 defined between the cylinder blocks 11, 12. A thrust bearing 33 is interposed between the inner end surface of the front cylinder block 11 and the its adjacent boss portion 31A of the swash plate 31. Another thrust bearing 34 is interposed between the inner end surface of the rear cylinder block 12 and its adjacent boss portion 31A of the swash plate 31. The thrust bearings 33, 34 rotatably hold the swash plate 31 at the boss portion 31A from opposite sides thereof for restricting the movement of the swash plate 31 along the axis line of the rotary shaft 29 indicated by symbol L.

Plural pairs of front and rear cylinder bores 35, 36 are arranged around the rotary shaft 29 in the front and rear cylinder blocks 11, 12, respectively. According to the first preferred embodiment, five pairs of cylinder bores 35, 36 are formed in the cylinder blocks 11, 12, though only one pair of such cylinder bores 35, 36 is shown in FIG. 1. Each pair of front and rear cylinder bores 35, 36 accommodate therein a double-headed piston 37 for reciprocating in the paired cylinder bores 35, 36.

The rotating motion of the awash plate 31 with the rotary shaft 29 is transmitted to each double-headed piston 37 through a pair of shoes 38, so that the double-headed piston 37 reciprocates in its associated cylinder bores 35, 36. Front and rear compression chambers 35A, 36A are defined by the respective front and rear cylinder bores 35, 36 and the double-headed piston 37. Though not shown in the drawing, five compression chambers are provided on each side of the front and rear cylinder bores 35, 36, thus a total of ten compression chambers are formed in the compressor 10. The shaft holes 11A, 12A of the cylinder blocks 11, 12, through which the rotary shaft 29 is inserted, is formed on the inner circumferential surfaces thereof with sealing surfaces 11B, 12B, respectively. The sealing circumferential surfaces 11B, 12B are smaller in radius of curvature than the rest of the inner circumferential surfaces of the shaft holes 11A, 12B. In other words, the rotary shaft 29 is directly supported by the cylinder blocks 11, 12 through their respective sealing circumferential surfaces 11B, 12B.

Figure 2:
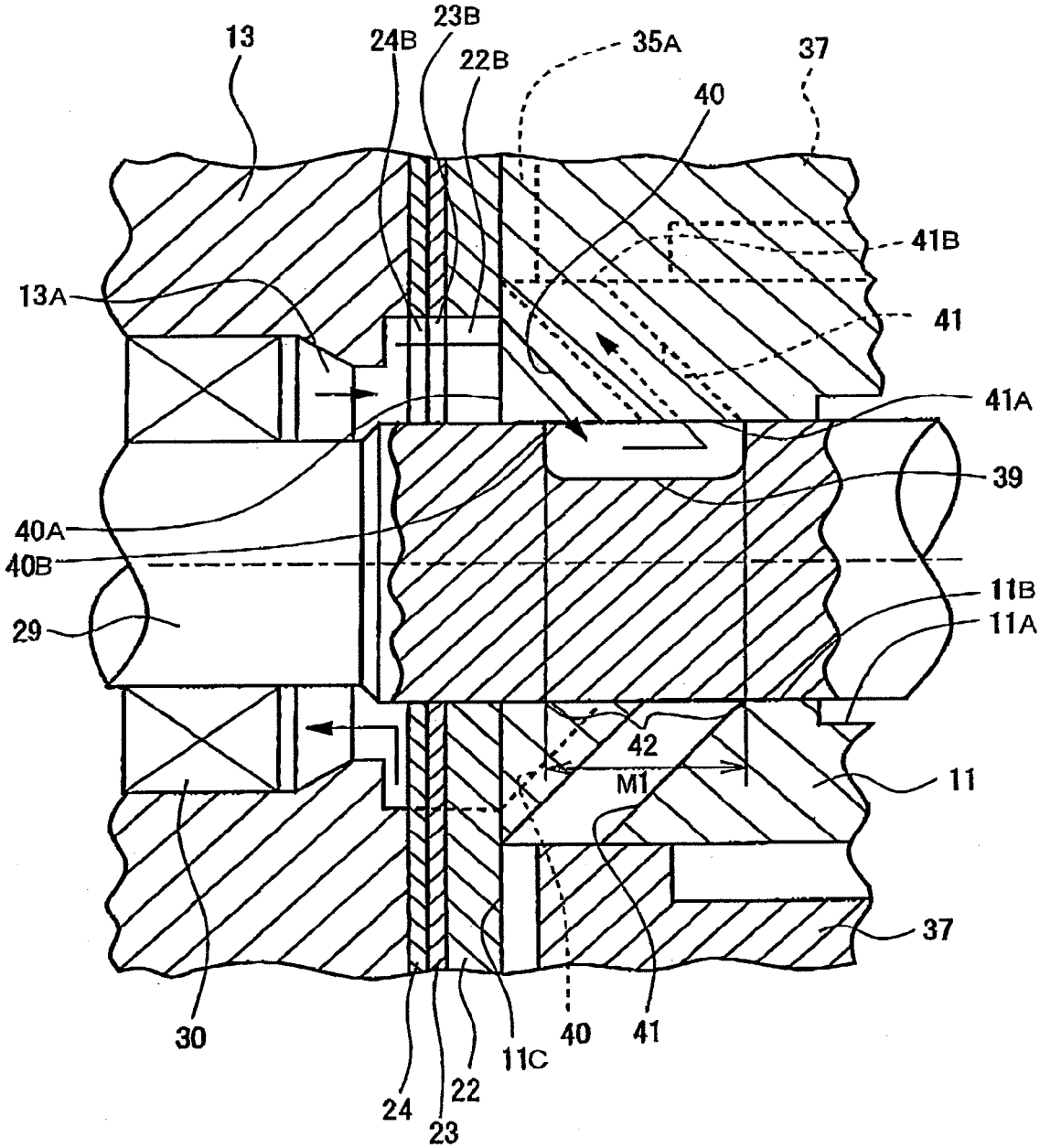
FIG. 2 is a fragmentary longitudinal cross-sectional view of the compressor of FIG. 1 showing a rotary valve of the compressor.
Figure 3:
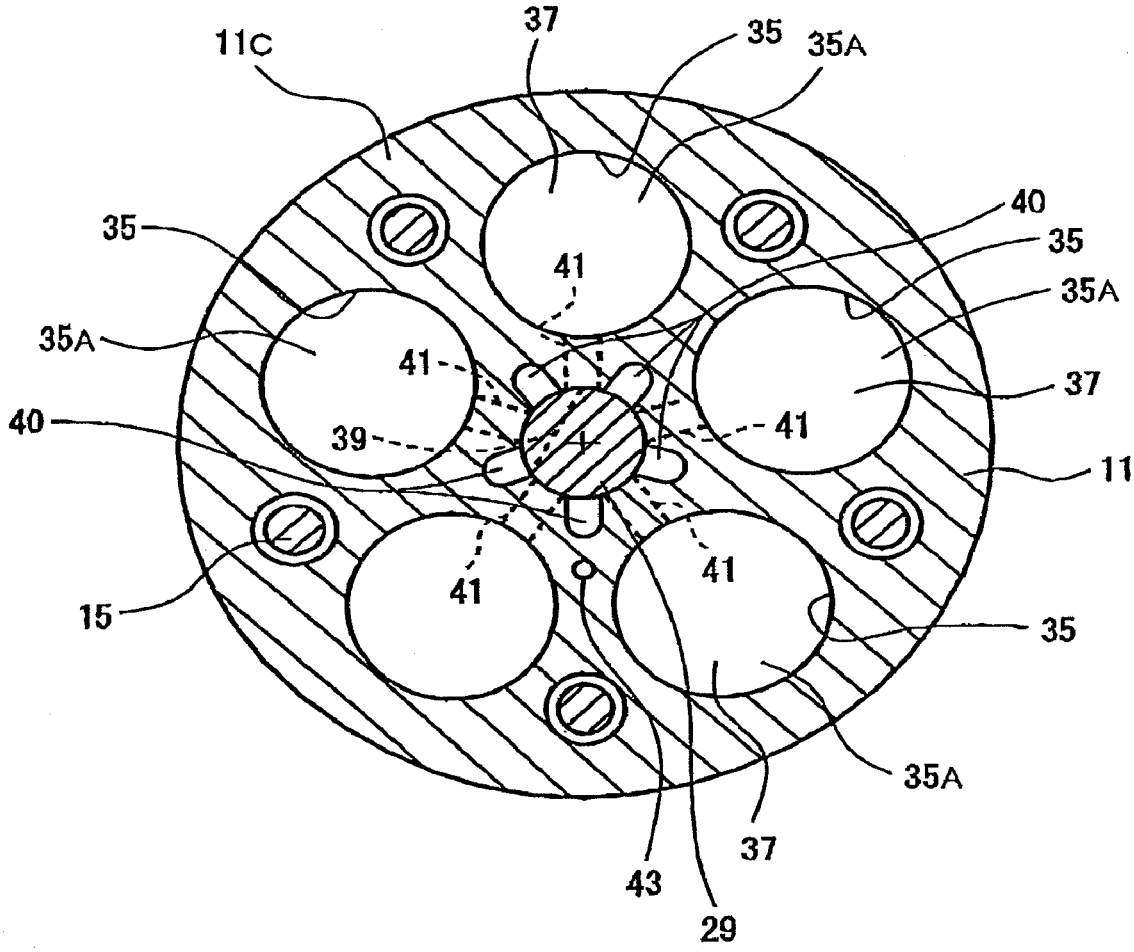
FIG. 3 is a cross-sectional view taken along the line I-I in FIG. 1.

The compressor 10 has an introduction passage for introducing refrigerant from the shaft seal chamber 13A serving as the front suction chamber into the front compression chambers 35A. As shown in FIGS. 1 and 2, the rotary shaft 29 is provided with a recessed passage 39 serving as a part of the introduction passage. The recessed passage 39 is formed by machining a groove or a recess in the outer circumferential surface of the rotary shaft 29 which extends behind the valve port plate 22 with a length M1 in the axial direction of the rotary shaft 29. As shown in FIGS. 1 through 3, the shaft hole 11A is provided at the outer edge of the front opening thereof with a plurality of notches 40. Each notch 40 serves as a communication passage connecting the shaft seal chamber 13A and the shaft hole 11A. The notches 40 may be formed by any cutout portion having such as V-shaped, or horseshoe cross-section thereof. As shown in FIG. 3, five notches 40 are substantially equally spaced apart around the rotary shaft 29. Only one notch 40 is shown in FIGS. 1 and 2.

As shown in FIG. 2, the notch 40 has an opening 40A at the end surface 11C of the front cylinder block 11 adjacent to the valve port plate 22. The valve port plate 22, the valve plate 23 and the retainer plate 24 are provided with a valve port 22B, a hole 23B and a hole 24B, respectively. The shaft seal chamber 13A is in constant communication with the space formed by the notch 40 through the valve port 22B, holes 23B, 24B and the opening 40A of the notch 40. On the other hand, the notch 40 has an opening 40B at the sealing circumferential surface 11B of the rotary shaft 29 in the shaft hole 11A. The part of the opening 40B of the notch 40 is formed so as to be openable through the opening 40B to the recessed passage 39, as shown in FIG. 2, in accordance with the rotation of the shaft 29. Specifically, as the rotary shaft 29 rotates, the space of the notch 40 intermittently communicates with the recessed passage 39 through the opening 40B, so that refrigerant is introduced from the shaft seal chamber 13A into the recessed passage 39 through the notch 40.

Figure 4:
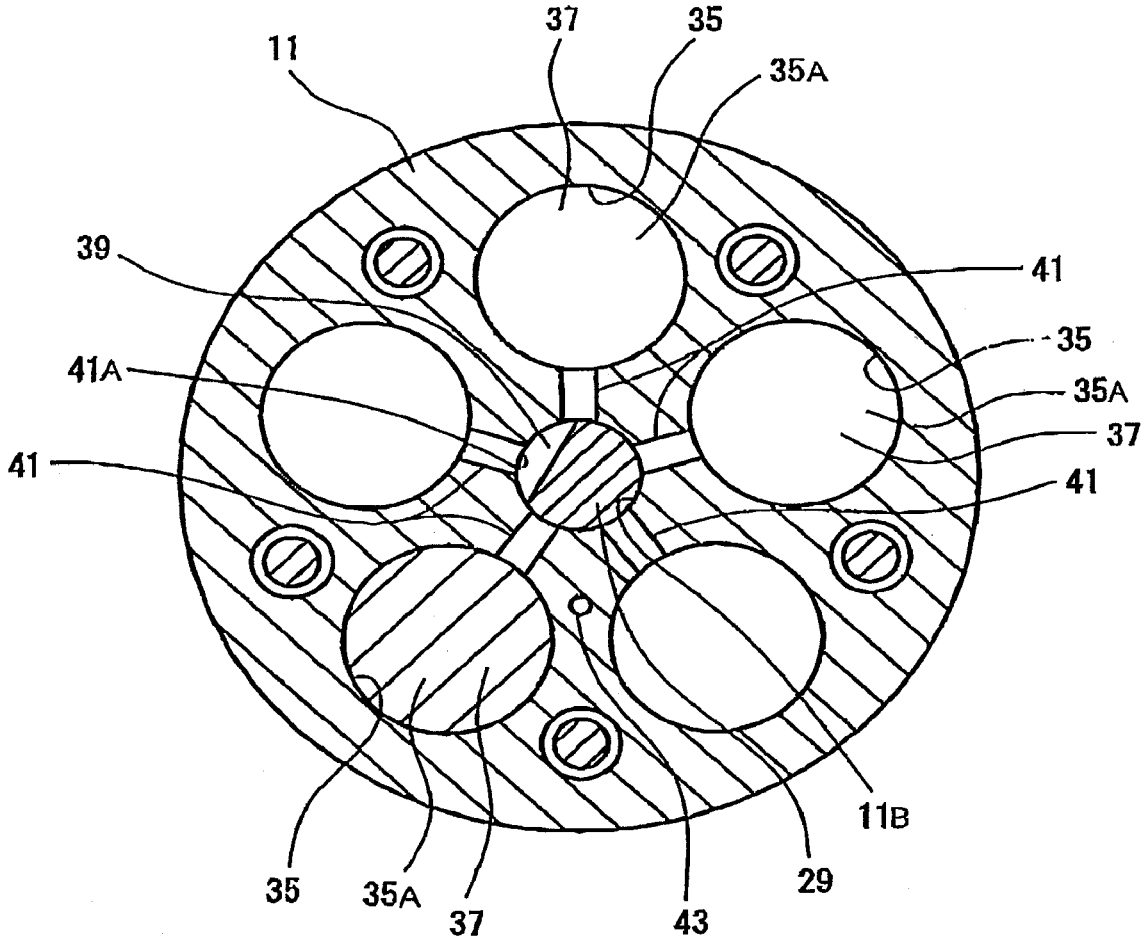
FIG. 4 is a cross-sectional view taken along the line II-II in FIG. 1.

The front cylinder block 11 has formed therein suction passages 41 for communication between the shaft hole 11A and the respective cylinder bores 35. Each suction passage 41 has an inlet end 41A and an outlet end 41B. The inlet end 41A of the suction passage 41 at the sealing circumferential surface 11B of the rotary shaft 29 in the shaft hole 11A and positioned so as to be openable to the recessed passage 39 in accordance with the rotation of the rotary shaft 29. The outlet end 41B of the suction passage 41 is open to the front compression chamber 35A in the cylinder bore 35. The suction passage 41 is inclined so that the inlet end 41A is positioned rearward of the outlet end 41B. As shown in FIG. 4, five suction passages 41 are substantially equally spaced apart around the rotary shaft 29 and extends radially outward. Only one suction passage 41 is shown in FIGS. 1 and 2. As the rotary shaft 29 rotates, each suction passage 41 intermittently communicates with the recessed passage 39 at the inlet end 41A thereof so that refrigerant is introduced from the recessed passage 39 into the front compression chambers 35A through the suction passages 41.

The part of the rotary shaft 29 provided with the recessed passage 39, which is disposed in the front shaft hole 11A and surrounded by the sealing circumferential surface 11B, serves as the rotary valve 42 operable to allow refrigerant to flow from the shaft seal chamber 13A into the front compression chamber 35A through notches 40 and suction passages 41. That is, the space of notches 40, the suction passages 41 and the recessed passage 39 communicate to form the introduction passage for introducing refrigerant from the front suction chamber serving as the shaft seal chamber 13A into the front compression chamber 35A.

The following will describe the arrangement of the recessed passage 39, notches 40 and suction passages 41.

Figure 5:
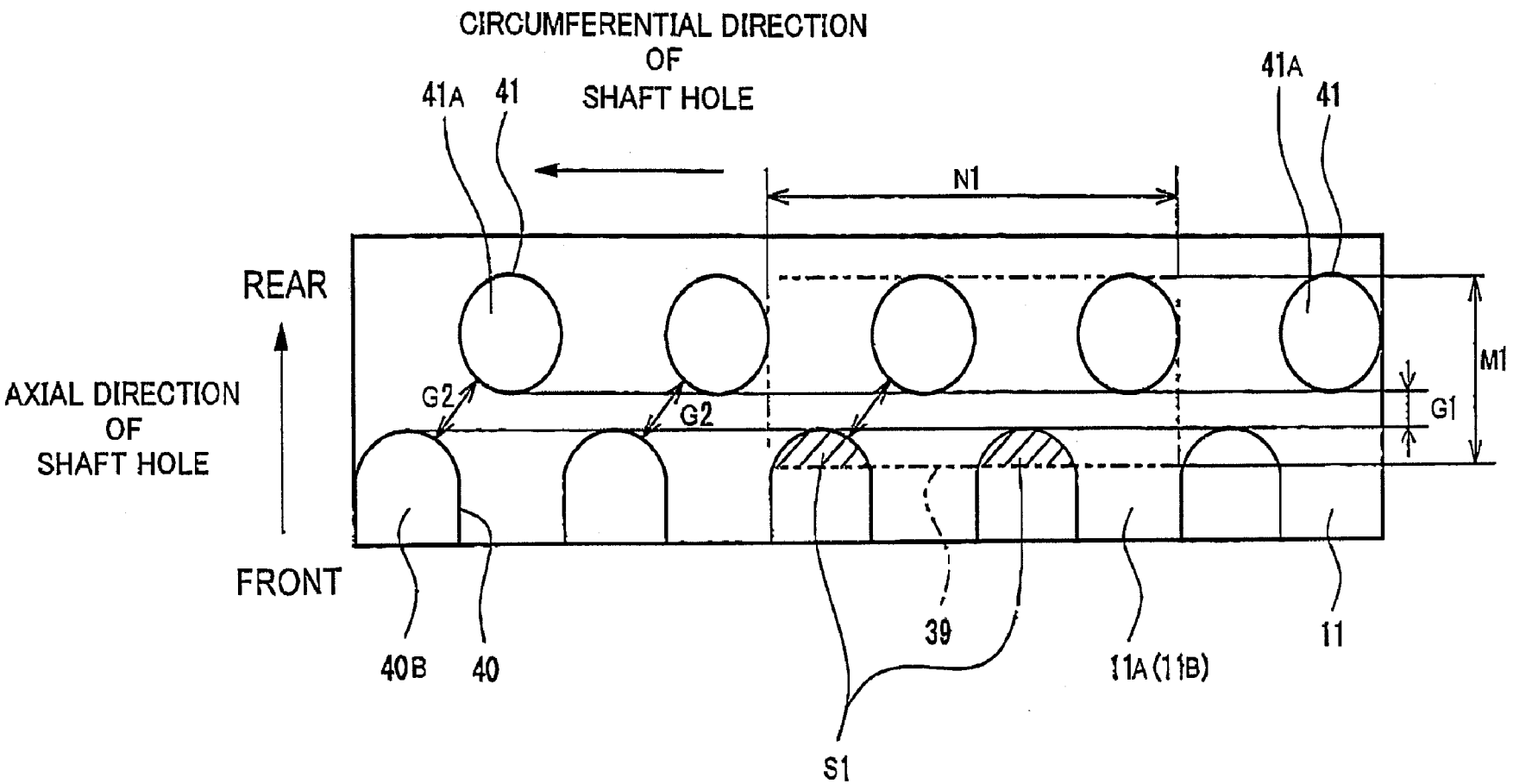
FIG. 5 is a development view of the rotary valve expanded in circumferential and axial directions of a shaft hole, showing a positional relation among openings at the shaft hole of notches, suction passages and a recessed passage according to the first embodiment of the present invention.

FIG. 5 is the development view of the rotary valve 42 showing the positional relation between openings 40B of the notches 40 at the shaft hole 11A and inlet ends 41A of the suction passages 41 at the shaft hole 11A. In FIG. 5, the vertical direction indicates the axial direction of the rotary shaft 29, that is, the upper side and lower side of the drawing correspond to the rear and front sides of the compressor 10, respectively. On the other hand, the horizontal direction of the drawing indicates the circumferential direction of the rotary shaft 29.

Five suction passages 41 and five notches 40 are formed in the front cylinder block 11. Five inlet ends 41A of the suction passages 41 are equally spaced in the circumferential direction, that is, the inlet ends 41A of the suction passages 41 are arranged at substantially equal angular intervals along the sealing circumferential surface 11B. Five openings 40B of the notches 40 are also equally spaced and disposed in a staggered arrangement in the circumferential direction with respect to the inlet ends 41A. That is, any two adjacent inlet end 41A of the suction passage 41 and the opening 40B of the notch 40 are staggered from each other in the circumferential direction by a distance corresponding to one-half of the angular interval. In FIG. 5, symbol G1 represents the axial distance between the inlet ends 41A of the suction passages 41 and the openings 40B of the notches 40. Symbol G2 represents the direct distance between any two adjacent inlet end 41A of the suction passage 41 and the opening 40B of the notch 40, which is the shortest distance in a straight line therebetween. When the minimum distance for ensuring the sealing function is represented by G0, the axial distance G1 is smaller than the direct distance G2 (G1<G2) and the direct distance G2 is greater than the distance G0 (G2>G0). Since the inlet end 41A of each suction passage 41 is staggered with respect to its adjacent opening 40B of the notch 40 in the circumferential direction, the axial distance between the inlet ends 41A of the suction passages 41 and the openings 40B of the notches 40 is set as short as possible while ensuring the direct distance G2 for performing the sealing function for preventing leakage of refrigerant.

In FIG. 5, the recessed passage 39 is indicated by two-dot chain line. The recessed passage 39 has a length M1 as measured in the axial direction of the rotary shaft 29 and a length N1 as measured in the circumferential direction. As the rotary shaft 29 rotates, the recessed passage 39 is rotated in the rotational direction of the rotary shaft 29. The axial length M1 of the recessed passage 39 is set so as to cover the entire width of the inlet end 41A of the suction passage 41 and a part of the width of the opening 40B of the notch 40. As the axial distance G1 between the inlet end 41A of the suction passage 41 and the opening 40B of the notch 40 is decreased, the axial length M1 of the recessed passage 39 can be set shorter. The circumferential length N1 is set so that the recessed passage 39 covers at least one opening 40B of the notch 40 at any angular position of the rotary shaft 29. Thus, the shaft seal chamber 13A is in constant communication with the recessed passage 39 through the opening 40B of the notch 40. Symbol S1 in FIG. 5 represents the total area of at least one opening 40B of the notch 40 covered by the recessed passage 39 as indicated by hatching. The amount of refrigerant introduced into the front compression chamber 35A through the recessed passage 39 and the suction passage 41 depends on the area S1. An increase of the area S1 increases the amount of refrigerant introduced into the front compression chamber 35A. An increase of the opening 40B in area of the notch 40 increases the area S1.

Referring back to FIG. 1, a communication passage 43 extends through the front housing 13, the valve port plate 22, the valve plate 23, the retainer plate 24 and the front cylinder block 11. Referring to FIGS. 3 and 4, the communication passage 43 is located in the lower side of the front cylinder block 11 and extends between two adjacent cylinder bores 35, 35. The inlet 43A of the communication passage 43 is open to the crank chamber 32, while the outlet 43B thereof is open to the shaft seal chamber 13A. Thus, the shaft seal chamber 13A is connected to the crank chamber 32 through the communication passage 43. On the other hand, a communication passage 44 extends through the rear housing 14 to provide fluid communication between the suction chamber 20 and the bolt insertion hole 16.

In the compressor 10 of the first preferred embodiment, the mechanism for introducing refigerant into the front compression chambers 35A defined in the front cylinder bores 35 of the front cylinder block 11 differs from the mechanism for introducing refrigerant into the rear compression chambers 36A defined in the rear cylinder bores 36 of the rear cylinder block 12. More specifically, the mechanism for introducing refrigerant into the front compression chambers 35A includes the rotary valve 42 connecting the shaft seal chamber 13A and front compression chambers 35A. The rotary valve 42 includes the recessed passage 39 providing fluid communication between the notches 40 and suction passages 41. On the other hand, the mechanism for introducing refrigerant into the rear compression chambers 36A includes suction valves 28A located between the suction chambers 20 and the rear compression chambers 36A. Each suction valve 28A is selectively opened and closed in accordance with the pressure differential between the suction chamber 20 and the rear compression chamber 36A.

The following will describe the operation of the compressor 10 configured as described above. Refrigerant in the external refrigerant circuit is introduced into the crank chamber 32 via the suction hole 21, and then flows through the communication passage 43 to reach the shaft seal chamber 13A of the shaft seal 30 serving as the suction chamber. The shaft seal chamber 13A is connected to each of the notches 40 through the valve port 22B, holes 23B, 24B provided in the valve port plate 22, the valve plate 23 and the retainer plate 24 respectively. The recessed passage 39 is formed in the circumferential surface of the rotary shaft 29 so as to cover the opening 40B of at least one notch 40 at any time during the operation of the compressor 10 when the rotary shaft 29 is rotating. Thus, the shaft seal chamber 13A is in constant communication with the recessed passage 39.

When a suction stroke takes place in the front cylinder bore 35, that is, when the double-headed piston 37 moves from the left side to the right side as shown in FIG. 1, the recessed passage 39 comes to be in communication with the inlet end 41A of the suction passage 41 associated with the cylinder bore 35 in the suction stroke, as shown in FIG. 4. Thus, refrigerant in the shaft seal chamber 13A is introduced into the front compression chamber 35A through the recessed passage 39 and the suction passage 41 by the operation of the rotary valve 42. At the end of the suction stroke, the recessed passage 39 is moved away from the inlet end 41A of the above suction passage 41 in the circumferential direction thereby to block the fluid communications therebetween. As a result, the flow of the refrigerant from the suction passage 41 to the front compression chambers 35A is stopped.

When a discharge stroke takes place in front cylinder bore 35, that is, when a double-headed piston 37 moves from the right side to the left side as shown in FIG. 1, the refrigerant in the cylinder bore 35 is compressed in its associated front compression chamber 35A and flows out from the corresponding discharge port 22A into the discharge chamber 18 while pushing open the associated discharge valve 23A. Then, the refrigerant discharged to the discharge chamber 18 flows through a communication passage (not shown) to the external refrigerant circuit through the discharge hole. Thus, the recessed passage 39 communicates with the inlet ends 41A of the suction passages 41 successively by the operation of the rotary valve 42 and the suction, compression and discharge strokes perform successively in the five front cylinder bores 35.

When a suction stroke takes place in a rear cylinder bore 36, that is, when a double-headed piston 37 moves from the right side to the left side as shown in FIG. 1, refrigerant is introduced from the suction chamber 20 into the rear compression chamber 36A through the suction port 25B and the suction valve 28A. That is, refrigerant in the external refrigerant circuit is introduced into the crank chamber 32 via the suction hole 21, and then flows through the bolt insertion hole 16 and the communication passage 44 into the suction chamber 20. The refrigerant in the suction chamber 20 is introduced into the rear compression chambers 36A through the suction port 25B while pushing open its associated suction valve 28A into the rear compression chamber 36A by virtue of a pressure differential between the suction chamber 20 and the rear compression chamber 36A. When a discharge stroke takes place in the rear cylinder bore 36, that is, when the double-headed piston 37 moves from the left side to the right side as shown in FIG. 1, refrigerant compressed in the rear compression chamber 36A is introduced into the discharge chamber 19 through the discharge port 25A while pushing open the associated discharge valve 26A to the discharge chamber 19. Refrigerant discharged into the discharge chamber 19 then flows out of the discharge hole of the compressor 10 into the external refrigerant circuit through a passage (not shown).

The compressor 10 according to the first preferred embodiment of the present invention offers the following advantageous effects.

(1) The front cylinder block 11 has notches 40 connecting the shaft seal chamber 13A and the shaft hole 11A through the end surface 11C of the front cylinder block 11. Refrigerant in the shaft seal chamber 13A of the shaft seal 13 is introduced into the recessed passage 39 formed in the outer circumferential surface of the rotary shaft 29 through the notches 40. Thus, unlike the structure of the conventional art, the recessed passage 39 need not extend for a long distance toward the shaft seal chamber 13A, that is, the length M1 of the recessed passage in the axial direction can be set at a reduced distance as compared to the conventional art. Further, the shaft seal 30 can be located close to the discharge valve plate 23. Accordingly, a decrease in the strength of the rotary shaft 29 is prevented and the size of the compressor 10 is possible to be reduced.

(2) Since each notch 40 serves as the communication passage connecting the shaft seal chamber 13A and the shaft hole 11A through the end surface 11C of the front cylinder block 11, the larger opening of the communication passage can be provided in comparison with a passage formed by a hole. Thus, a large amount of fluid such as refrigerant and lubricating oil contained therein can be introduced into the front compression chambers 35A. Further, the notch 40 can be provided at the edge of the shaft hole 11A more easily than forming a hole through the wall of the rotary shaft 29 as a communication passage. Thus, the production cost of a compressor having the notch 40 as the communication passage is less as compared to that having the hole as the communication passage.

(3) As shown in the development view of the rotary valve 42 in the rotational direction thereof, the inlet end 41A of each suction passage 41 is staggered in the circumferential direction from its adjacent opening 40B of the notch 40 by a distance corresponding to one-half of the angular interval at which the inlet ends 41A are spaced in the circumferential direction. That is, the opening 40B of each notch 40 is positioned between any two adjacent inlet ends 41A of the suction passages 41. According to the above-described embodiment, the axial distance G1 between the inlet ends 41A of the suction passages 41 and the openings 40B of the notches 40 is less than the direct distance G2 from the inlet end 41A of the suction passage 41 to the adjacent opening 40B of the notch 40 (or G1<G2). Additionally, the direct distance G2 is greater than the distance G0 representing the minimum axial distance between the inlet ends 41A and the openings 40B to ensure the sealing function (or G2>G0). The relation between the distances G2, G0 (G2>G0) provides reliability in the sealing function. Further, the relation between the distances G1, G2 (G1<G2) in the axial direction allows the opening 40B of the notch 40 and the inlet end 41A of the suction passage 41 to be located close to each other in the axial direction. Accordingly, the length M1 of the recessed passage 39 in the axial direction is set short while ensuring the reliable sealing function.

(4) The shaft seal chamber 13A and the suction chamber 20 are respectively in communication with the suction hole 21 through the crank chamber 32, so that refrigerant containing lubricating oil is introduced from the suction hole 21 into the crank chamber 32. Thus, the lubrication of the sliding parts in the crank chamber 32 is improved.

(5) The shaft seal 30 is cooled by the refrigerant being supplied from the crank chamber 32 to the rotary valve 42 via the shaft seal chamber 13A, with the result that the serviceable life of the shaft seal 30 is extended.

Figure 6:
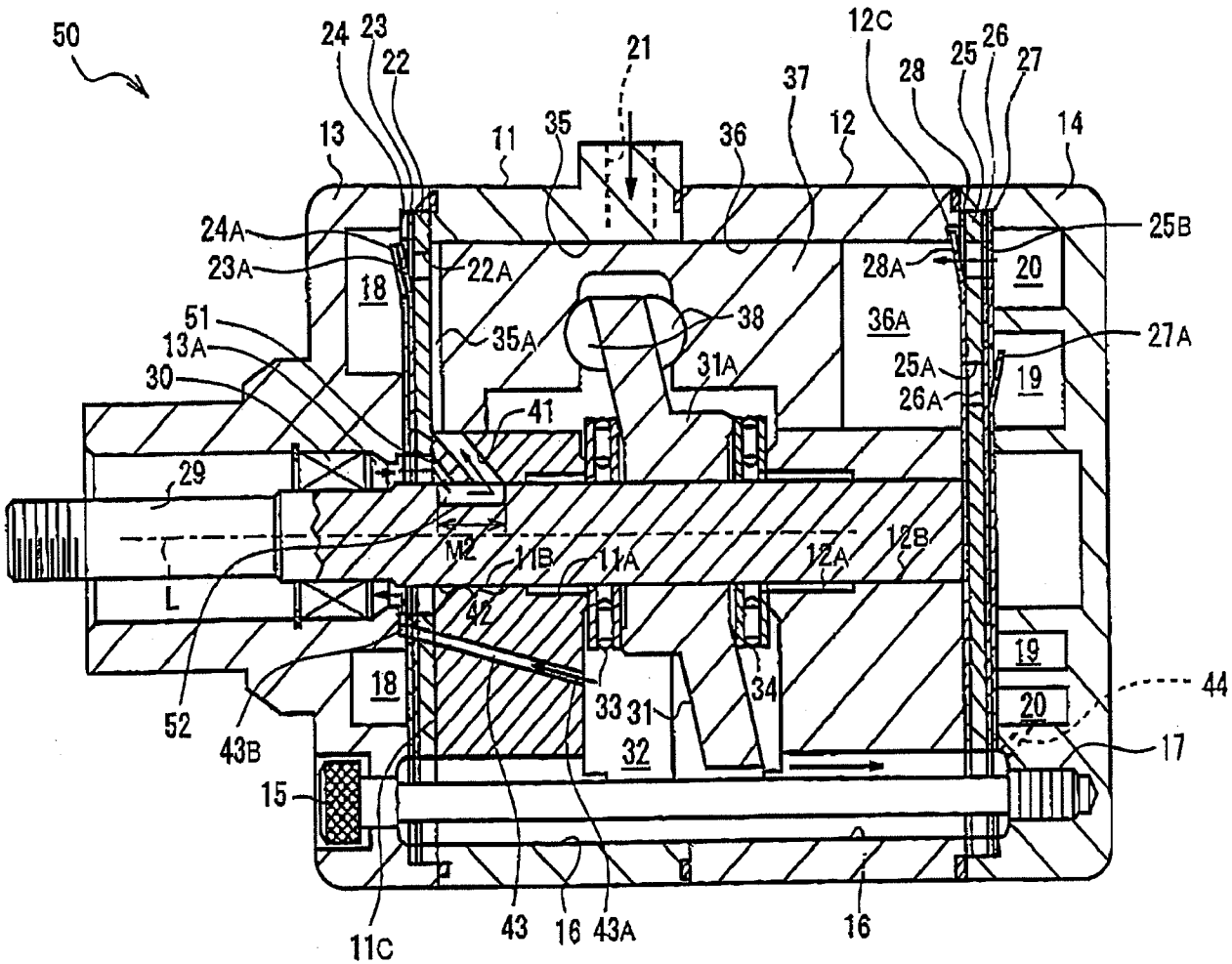
FIG. 6 is a longitudinal cross-sectional view of a double-headed piston type compressor according to a second preferred embodiment of the present invention.
Figure 7:
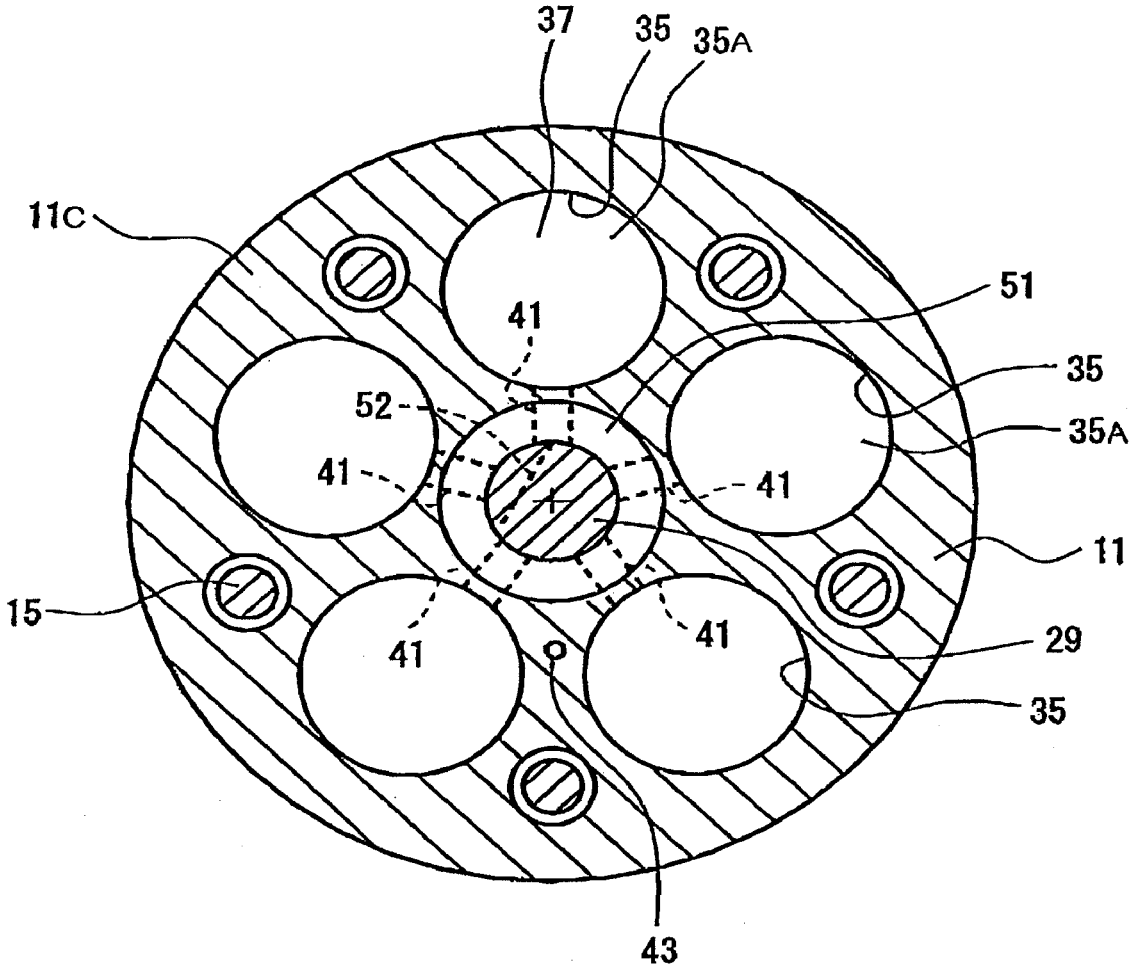
FIG. 7 is a cross-sectional view similar to that of FIG. 3, but showing the compressor of FIG. 6 according to the second preferred embodiment of the present invention.
Figure 8:
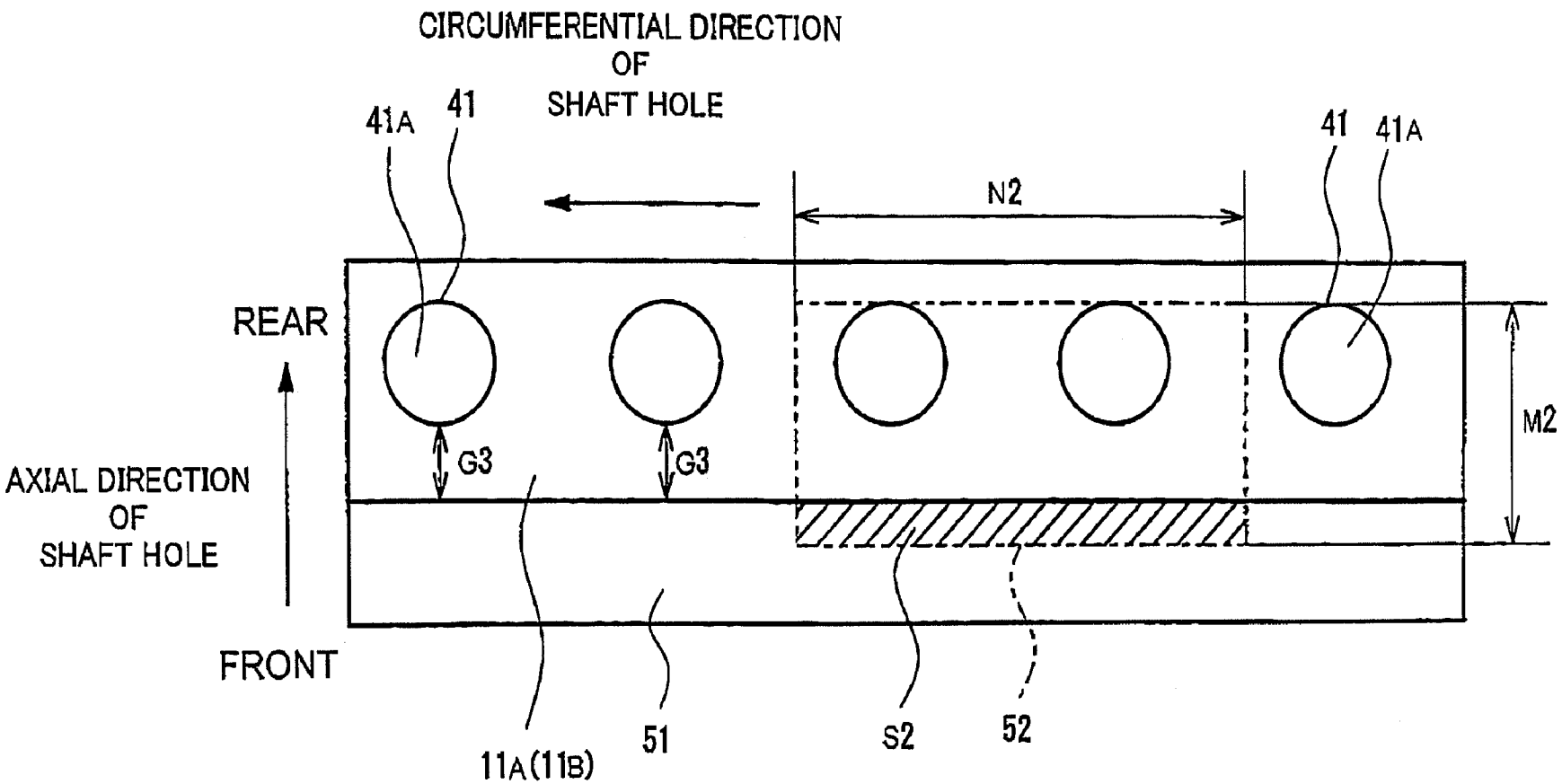
FIG. 8 is a development view similar to that of FIG. 5, but showing the rotary valve in the compressor of FIG. 6 according to the second embodiment of the present invention.

The following will describe a double-headed piston type compressor 50 according to the second preferred embodiment of the present invention with reference to FIGS. 6 through 8. The double-headed piston type compressor 50 (hereinafter referred to as "compressor") of the second preferred embodiment differs from that of the first preferred embodiment in that the notches 40 serving as communication passages are modified. The other structure of the compressor 50 is substantially the same as the compressor 10 of the first preferred embodiment. For the sake of convenience of explanation, therefore, like or same parts or elements will be referred to by the same reference numerals as those which have been used in the first preferred embodiment, and the description thereof will be omitted.

As shown in FIGS. 6 and 7, the edge of the front opening of the shaft hole 11A is tapered to provide a tapered passage 51 around the shaft hole 11A in the front cylinder block 11. The tapered passage 51 serves as a communication passage connecting the shaft seal chamber 13A and the shaft hole 11A through the front end surface 11C thereof. Since the tapered passage 51 is formed around the entirety of the shaft hole 11A, the tapered passage 51 is in constant communication with a recessed passage 52.

The following will describe the arrangement of the recessed passage 52, the tapered passage 51 provided by tapering the front opening of the shaft hole 11A and suction passages 41. FIG. 8 is the development view of the rotary valve 42 showing the positional relation between the tapered passage 51 along the tapered circumference of the shaft hole 11A and inlet ends 41A of the suction passages 41 at the shaft hole 11A. In FIG. 8, the vertical direction indicates the axial direction of the rotary shaft 29, that is, upper and lower sides correspond to the rear and front sides of the compressor 10, respectively. On the other hand, the horizontal direction in the drawing indicates the circumferential direction of the rotary shaft 29.

In FIG. 8, the tapered passage 51 is illustrated like a belt extending in the horizontal direction. Symbol G3 represents the axial distance between the inlet ends 41A of the suction passages 41 and the tapered passage 51. The distance G3 is set greater than the distance G0 which is the minimum distance between the inlet ends 41A and the tapered passage 51 to ensure the sealing function.

In FIG. 8, the recessed passage 52 is indicated by two-dot chain line. The recessed passage 52 has a length M2 as measured in the axial direction of the rotary shaft 29 and a length N2 as measured in the circumferential direction. As the rotary shaft 29 rotates, the recessed passage 52 is rotated in the rotational direction of the rotary shaft 29. The axial length M2 of the recessed passage 52 is set so as to cover the entire width of the inlet end 41A of the suction passage 41 and a part of the tapered passage 51. The axial length M2 is set greater than the length M1 of the first preferred embodiment. Since the tapered passage 51 is formed along the entire circumference of the rotary shaft 29, the recessed passage 52 constantly covers a part of the tapered passage 51 regardless of the rotation angle of the rotary shaft 29. Thus, the shaft seal chamber 13A is in constant communication with the recessed passage 52 through the tapered passage 51. An area S2 indicated by hatching in FIG. 8 represents the area overlapped between the recessed passage 52 and the tapered passage 51. The amount of refrigerant to be introduced into the front compression chambers 35A through the recessed passage 52 and the suction passages 41 depends on the area S2. The larger area S2 increases the amount of refrigerant introduced into the front compression chambers 35A.

Therefore, the second preferred embodiment has the following advantageous effects in addition to the effects (1), (4) and (5) of the first preferred embodiment.

(6) Since the tapered passage 51 provided by tapering the edge of the front opening of the shaft hole 11A serves as the communication passage connecting the shaft seal chamber 13A and the shaft hole 11A through the front end surface 11C of the front cylinder block 11, the larger opening of the communication passage can be provided in comparison with a passage formed by notches, holes and the like. Further, tapering edge of the front opening of the shaft hole 11A to provide the tapered passage 51 is simple and, therefore, the production cost of a compressor is more reduced.

The present invention is not limited to the above-described embodiments, but may be modified into various alternative embodiments, as exemplified below.

In the first preferred embodiment, the length G1 can be set zero or less. That is, the inlet ends 41A of the suction passages 41 may be arranged so as to overlap the openings 40B of the notches 40 in the axial direction. This arrangement allows the length M1 in the axial direction to be shorter.

In the first preferred embodiment, the notches 40 serve as the communication passage connecting the shaft seal chamber 13A and the shaft hole 11A through the front end surface 11C. Alternatively, communication holes may be provided for serving as the communication passage.

In the first preferred embodiment, the inlet end 41A of each suction passage 41 is staggered in the circumferential direction from its corresponding opening 40B of the notch 40 by a distance corresponding to one-half of the angular interval at which the inlet ends 41A are spaced in the circumferential direction. Alternatively, the positional relation between the inlet end 41A and the opening 40B may be changed as required.

In the second preferred embodiment, the tapered passage 51 provided by tapering the front opening of the shaft hole 11A serves as the communication passage connecting the shaft seal chamber 13A and the shaft hole 11A through the front end surface 11C. Alternatively, counterbores may be provided for serving as the communication passage.

In the first and second preferred embodiments, the refrigerant is introduced from the suction hole 21 into the shaft seal chamber 13A and the suction chamber 20 through the crank chamber 32. Alternatively, a passage may be provided in the front housing 13 or the rear housing 14 for connecting the suction hole 21 to the shaft seal chamber 13A or to the suction chamber 20.

In the first and second preferred embodiments, the compressor has five paired front and rear cylinder bores 35, 36 in each paired front and rear cylinder blocks 11, 12 to form five cylinders. The number of the cylinders may be changed as required.

The suction mechanism for introducing refrigerant into the rear compression chambers 36A of the compressor may be provided with a rotary valve instead of the suction valve 28A.

What is claimed is:

1. A double-headed piston type compressor comprising:

a housing assembly including a front housing, a rear housing and a cylinder block held between the front housing and the rear housing, the cylinder block defining therein a crank chamber and a plurality of cylinder bores and having a shaft hole therethrough;

a double-headed piston accommodated in the cylinder bores for reciprocating therein;

a rotary shaft rotatably supported by the shaft hole of the cylinder block;

a swash plate accommodated in the crank chamber for rotation with the rotary shaft, the swash plate rotating for allowing the double-headed piston to reciprocate in the cylinder bores;

a shaft seal arranged between the front housing and the rotary shaft;

compression chambers defined by the cylinder bores in the cylinder block;

a suction chamber defined by the front housing; and an introduction passage having a rotary valve for introducing refrigerant from the suction chamber into the compression chambers, wherein the introduction passage includes a plurality of communication passages formed in the cylinder block for connecting the suction chamber to the shaft hole, the communication passages being formed by a plurality of notches provided at the outer edge of the opening of the shaft hole;

suction passages connecting the shaft hole and the compression chambers; and a recessed passage formed in the outer circumferential surface of the rotary shaft for connecting intermittently between the communication passage and the respective suction passages in accordance with the rotation of the rotary shaft.

2. The double-headed piston type compressor according to claim 1, wherein the communication passages and the suction passages have openings at the shaft hole, the openings of the communication passages are respectively staggered from the openings of the suction passages in the circumferential direction of the shaft hole.

3. The double-headed piston type compressor according to claim 1, wherein the recessed passage extends in the axial direction so as to cover the entire opening at the shaft hole of the suction passage and a part of the opening at the shaft hole of the communication passage.

4. The double-headed piston type compressor according to claim 1, the recessed passage has a circumferential length of the rotary shaft so as to cover at least one opening at the shaft hole of the communication passage at any angular position of the rotary shaft.

5. The double-headed piston type compressor according to claim 1, wherein the suction chamber serves as a shaft seal chamber having therein the shaft seal.

6. The double-headed piston type compressor according to claim 1, further comprising a suction hole for introducing refrigerant from an external refrigerant circuit into the suction chamber through the crank chamber.

7. The double-headed piston type compressor according to claim 2, wherein the openings at the shaft hole of the communication passages and the suction passages are arranged at equal angular intervals along the circumferential surface of the shaft hole respectively and staggered from respective others in the circumferential direction by distances corresponding to is one-half of the angular interval.

8. The double-headed piston type compressor according to claim 2, wherein the axial distances between the respective openings at the shaft hole of the communication passages and the respective openings at the shaft hole of the suction passages are smaller than the direct distances from the respective openings at the shaft hole of the suction passages to the respective adjacent openings at the shaft hole of the communication passages.

9. A double-headed piston type compressor comprising:

a housing assembly including a front housing, a rear housing and a cylinder block held between the front housing and the rear housing, the cylinder block defining therein a crank chamber and a plurality of cylinder bores and having a shaft hole therethrough;

a double-headed piston accommodated in the cylinder bores for reciprocating therein;

a rotary shaft rotatably supported by the shaft hole of the cylinder block;

a swash plate accommodated in the crank chamber for rotation with the rotatory shaft, the swash plate rotating for allowing the double-headed piston to reciprocate in the cylinder bores;

a shaft seal arranged between the front housing and the rotary shaft;

compression chambers defined by the cylinder bores in the cylinder block;

a suction chamber defined by the front housing;

an introduction passage having a rotary valve for introducing refrigerant from the suction chamber into the compression chambers, wherein the introduction passage includes;

a communication passage formed in the cylinder block for connecting the suction chamber to the shaft hole, the communication passage being provided by tapering the edge of the front opening of the shaft hole around the entirety of the shaft hole;

suction passages connecting the shaft hole and the compression chambers; and a recessed passage formed in the outer circumferential surface of the rotary shaft for connecting intermittently between the communication passage and the respective suction passages in accordance with the rotation of the rotary shaft.

* * * * *